US007112445B1

(12) United States Patent
Welle

(10) Patent No.: US 7,112,445 B1
(45) Date of Patent: Sep. 26, 2006

(54) FRAGMENTED TAGGANT CODING SYSTEM AND METHOD WITH APPLICATION TO AMMUNITION TAGGING

(76) Inventor: Richard P Welle, 16351 Grenoble La., Huntington Beach, CA (US) 92649

( * ) Notice: Subject to any disclaimer, the term of this patent is extended or adjusted under 35 U.S.C. 154(b) by 0 days.

(21) Appl. No.: 09/993,467

(22) PCT Filed: May 19, 2000

(86) PCT No.: PCT/US00/13937

§ 371 (c)(1),
(2), (4) Date: Nov. 19, 2001

(87) PCT Pub. No.: WO00/71966

PCT Pub. Date: Nov. 30, 2000

(51) Int. Cl.
*G01N 37/00* (2006.01)

(52) U.S. Cl. ..... 436/56

(58) Field of Classification Search ..... 436/56
See application file for complete search history.

(56) References Cited

U.S. PATENT DOCUMENTS

| | | | | |
|---|---|---|---|---|
| 1,650,908 A | | 11/1927 | Ramsey | |
| 3,733,178 A | * | 5/1973 | Eriksen | 436/56 |
| 3,772,200 A | | 11/1973 | Livesay | |
| 4,018,635 A | | 4/1977 | Ryan | |
| 4,131,064 A | | 12/1978 | Ryan | |
| 4,222,330 A | | 9/1980 | Krystyniak | |
| 4,329,393 A | | 5/1982 | LaPerre | |
| 4,359,353 A | | 11/1982 | Kydd | |
| 4,359,399 A | | 11/1982 | Boyars | |
| 4,363,678 A | | 12/1982 | Nishimura | |
| 4,399,226 A | | 8/1983 | Danielson | |
| 4,455,179 A | | 6/1984 | Yamaguchi | |
| 5,279,967 A | * | 1/1994 | Bode | 436/56 |
| 5,646,365 A | | 7/1997 | Collier | |
| 5,760,394 A | * | 6/1998 | Welle | 250/303 |
| 6,082,264 A | | 7/2000 | Meyer | |
| 6,647,649 B1 | * | 11/2003 | Hunt et al. | 40/326 |

FOREIGN PATENT DOCUMENTS

| | | |
|---|---|---|
| WO | WO 97/21067 | 6/1997 |

* cited by examiner

*Primary Examiner*—Monique T. Cole
(74) *Attorney, Agent, or Firm*—Lewis Brisbois Bisgaard & Smith LLP; Jon E. Hokanson

(57) ABSTRACT

The present invention relates to identification tagging, and is specifically directed to identification tagging of ammunition. An isotopic taggant is deposited in a layer at the interface between the primer and the propellant so that, as the ammunition is fired, the taggant is dispersed throughout the propellant. The taggant is thus contained in the gunshot residue formed during the firing, and can be read by analysis of residue particles. Alternatively, the taggant may be deposited in a layer under the primer reactants, or in pellets which are easily destroyed by the chemical reactions involved in firing the ammunition, again dispersing the taggant throughout the propellant and the gunshot residue. Non-isotopic chemical taggants may also be employed if they are encoded so as to minimize the possibility of the information being destroyed or improperly read after the taggants are exposed to the chemical reactions in firing the ammunition. This is accomplished by employing a binary coding system and a system of authentication tags. Particulate taggants may also be used. The required large number of unique identification tags are obtained by using a fragmented coding system wherein each particle encodes only a portion of the serial number.

8 Claims, 1 Drawing Sheet

FRAGMENTED TAGGANT CODING SYSTEM AND METHOD WITH APPLICATION TO AMMUNITION TAGGING

TECHNICAL FIELD

The present invention relates to the field of identification taggants. More specifically, the present invention relates to the identification tagging of ammunition, such as small arms ammunition.

BACKGROUND ART

A number of systems have been proposed for use as identification taggants, with an extensive body of work investigating methods for tagging explosives.

With respect to ammunition, a system has been proposed and tested wherein the addition of rare-earth elements to ammunition enhanced the delectability of gunshot residue by giving it an unambiguous composition due to incorporation of elements which are easily detected by neutron activation (Bryan et al., 1966). This method was only intended to provide a positive indication of the presence of gunshot residue. It was neither capable of encoding a usefully large number of identification codes, nor was any attempt made to encode any identification information in the taggants.

DISCLOSURE OF INVENTION

It is an object of this invention to provide a system of and a method for coding taggants which will facilitate economic generation of a very large number of unique identifying codes. The method employs a fragmented coding scheme where a code is comprised of several individual components which are not physically connected to one another.

It is further an object of this invention to provide a system of and a method for coding taggants which will minimize the probability of false code readings in chemically reacting or contaminated systems. The method employs a binary or related coding system wherein the value of each bit of the code is indicated by the presence of one component, and the absence of the other component, of a designated pair of chemicals. The method further employs an authentication code system.

It is further an object of this invention to provide a system of and a method for tagging ammunition which will minimize concerns about taggant effects on safety and reliability of the tagged ammunition. The method employs a taggant embedded in a thin layer between the primer and propellant in an ammunition round. The method further employs additional layers of material isolating the taggant layer from the primer and the propellant.

BRIEF DESCRIPTION OF THE DRAWINGS

Other objects and advantages of the invention will become apparent from the foregoing detailed description taken in connection with the accompanying drawings, in which.

BEST MODE FOR CARRYING OUT THE INVENTION

Figure 1:
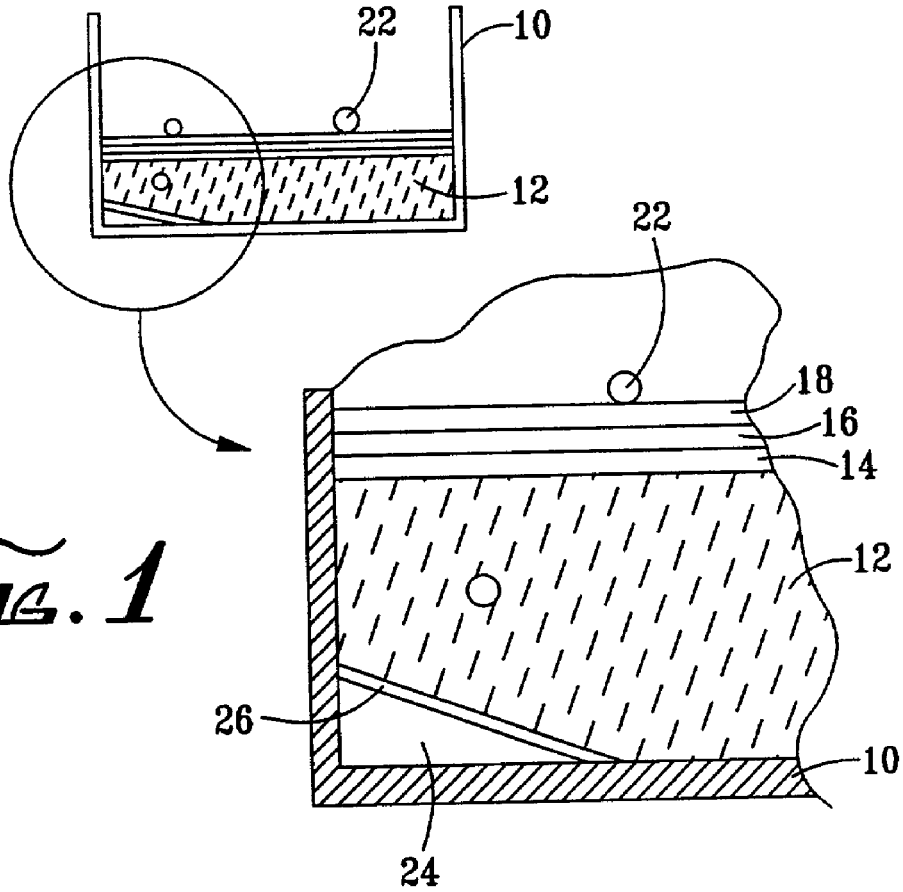
FIG. 1 is a partial cross-sectional view of a primer adapted for use with preferred embodiments of the present invention.

Known taggant systems and methods fall into three categories. These include: (1) survivable distributed systems and methods; (2) semi-survivable distributed systems and methods; and (3) particulate systems and methods.

Distributed Systems

Distributed systems encode the taggant information in substances which are distributed through one or more components of the ammunition. These taggants encode information either in the presence or absence of certain chemical substances, or in the relative concentration of certain chemical substances. In distributed systems, the tagging chemicals are directly mixed with other components of the ammunition, and may be exposed to the chemical reactions involved in firing the ammunition. This leads to the further subdivision of the distributed category into the survivable and semi-survivable sub-categories. The survivable systems are those in which the taggant information is encoded in substances which, preferably, will not be altered in any way by chemical reactions. The semi-survivable systems include chemicals which may be affected by the chemical reactions, but for which, preferably, the taggant information has a high probability of surviving the reactions.

Of the known systems, only radioactive tracer and isotope ratio systems can be classed as survivable distributed systems. Both of these systems encode information in the isotopic composition of single elements. The chemical reactions involved in firing ammunition will have no significant effect on isotopic compositions. As long as enough atoms can be recovered to determine the isotopic composition of the relevant elements, the taggant information can be read.

The semi-survivable systems include chemical tracer and isotopic substitution systems. The chemical tracer system, using rare-earth elements, is considered semi-survivable because the taggant information is encoded in the relative concentration of different elements. Although these ratios are likely to be little affected by the chemical reactions involved in firing ammunition, it cannot be said with certainty that the effect will be negligible. This decreases the degree of reliability of the tagging information obtained by analyzing the residue of expended ammunition tagged with this system. The isotopic substitution system is considered semi-survivable because the chemicals containing the isotopes may be destroyed in the chemical reactions of the ammunition. Although the isotopes themselves cannot be destroyed, the information is encoded in the presence of the isotopes in the substituted chemicals. If the chemicals are destroyed, the taggant information is lost. If the taggant information is encoded in the relative concentration of different substituted chemical compounds, then the taggant information could become corrupted by selective destruction of one of the substituted compounds. In one alternative system information is encoded in the presence or absence of each of a number of chemical elements, isotopes, or compounds in a pre-defined set. This gives improved reliability over the concentration method, but there is still some uncertainty in that some chemical compounds which are initially present in the taggant could be destroyed in firing the ammunition. In the subsequent analysis, it would not be possible to determine whether the absence of a particular compound was the result of its initial absence, or its destruction in the firing. This could lead to incorrect reading of the taggant information.

An improved coding scheme has been devised which will provide an indication when tagging chemicals are destroyed. In such a case, the analysis will lead to information which is ambiguous rather than erroneous. The method works by using a binary coding scheme where each bit in the binary code is represented by two chemicals, identified for illustration purposes as chemical A and chemical B. In a representative system the presence of chemical A would indicate a bit value of 0, while the presence of chemical B would indicate a bit value of 1. In analyzing a sample, four outcomes are possible. (1) The presence of only chemical A would indicate a bit value of 0. (2) The presence of only chemical B would indicate a bit value of 1. (3) The absence of both chemicals would indicate that the tagging chemical, and therefore the taggant information, had been destroyed. (4) The presence of both chemicals would indicate that the system had been contaminated, and that therefore the tagging information had been destroyed.

Thus, under most circumstances, the analysis will either give the correct result, or indicate that the information had been destroyed. An incorrect result is possible only in a case where the correct tagging chemical had been destroyed, and the system had been contaminated with the incorrect tagging chemical.

With only two chemicals, one can tag no more than two separate batches of ammunition. A useful system must be able to provide unique identifying information for far more than two batches, and must be able to encode identifying information corresponding to any type of alphanumeric or other identifier. Most commonly, such an identifier would be a serial number composed of arabic numerals, although other identification systems are possible. The term "serial number" is used hereinafter to encompass all types of symbolic identifiers. By combining multiple pairs of chemicals to build up a binary serial number, an arbitrarily large number of batches can be tagged. For example, to identify one million separate batches would require a binary serial number 20 bits long ($2^{20}$=1,048,576). Tagging these batches using this system would require 40 distinct chemicals, with each of 20 pairs being used to identify the value of one bit in the serial number. If, in analyzing a sample from one of these batches of ammunition, only 19 of the expected 20 chemicals are found, then one bit of the serial number is lost. However, this still narrows the serial number from one million possibilities to only two.

While the system is simple with a binary coding scheme i.e., using base-2 numbers, there may be benefits to using other bases. For example, triplets of chemicals could be used to encode a base-3 serial number. In this system, the presence of chemical A, B, or C would indicate a value of 0, 1, or 2 for one trit (base-3 digit) in the serial number. The absence of all three of these chemicals would indicate a loss of information, and the presence of two or more of the chemicals would indicate contamination. Using this system, one million batches of ammunition could be tagged with 39 chemicals in 13 triplets ($3^{13}$=1,594,323). Other bases could also be used, but as the base number gets larger, a point is reached where more rather than fewer tagging chemicals are required. A base-10 system for example, would require 60 chemicals to tag one million batches. The coding system described here could be implemented using ordinary chemical compounds, using compounds in which one or more atoms are substituted with rare isotopes, or using isotopes themselves.

While these improvements will make a semi-survivable distributed system more reliable, survivable systems may be preferable.

One survivable distributed tagging system of the present invention employs only stable isotopes. In this system, unique taggants, each corresponding to a unique identification code, are created by mixing unique combinations of ratios of multiple stable isotopes of one or more elements. The resulting mixture is added to the substance or product to be tagged. When identification is required, the isotope abundance ratios of the taggant element or elements are measured, and the resultant measurements are compared with the appropriate identification tagging records made at the time the substance was tagged.

A code based on an abundance ratio of multiple isotopes of a single element presents two distinct advantages over systems using abundance ratios of elements or compounds. First, the isotopic abundance ratios can be more precisely measured than abundance ratios of elements or compounds. Second, the isotopic abundance ratio will not be modified by non-nuclear physical or chemical processes except those specifically designed for isotope separation, so the taggant code will not be destroyed by chemical reactions or explosions.

Elements which could be used for this technique include any element with more than one stable isotope. Of the 83 non-radioactive elements known to exist on earth, 62 have more than one stable isotope, and 40 have more than two stable isotopes. The element tin (Sn) has the largest number (10) of stable isotopes for any single element. The following table lists the symbol of each element under the number of stable isotopes for each of the naturally occurring stable elements.

TABLE I

| Elements grouped according to their number of stable isotopes | | | | | | | | | |
|---|---|---|---|---|---|---|---|---|---|
| 1 | 2 | 3 | 4 | 5 | 6 | 7 | 8 | 9 | 10 |
| Be | H | O | S | Ti | Ca | Mo | Cd | Xe | Sn |
| F | He | Ne | Cr | Ni | Se | Ru | Te | | |
| Na | Li | Mg | Fe | Zn | Kr | Ba | | | |
| Al | B | Si | Sr | Ge | Pd | Nd | | | |
| P | C | Ar | Ce | Zr | Er | Sm | | | |
| Sc | N | K | Pb | W | Hf | Gd | | | |
| Mn | Cl | U | | | Pt | Dy | | | |
| Co | V | | | | | Yb | | | |
| As | Cu | | | | | Os | | | |
| Y | Ga | | | | | Hg | | | |
| Nb | Br | | | | | | | | |
| Rh | Rb | | | | | | | | |
| I | Ag | | | | | | | | |
| Cs | In | | | | | | | | |
| Pr | Sb | | | | | | | | |
| Tb | La | | | | | | | | |
| Ho | Eu | | | | | | | | |
| Tm | Lu | | | | | | | | |
| Au | Ta | | | | | | | | |
| Bi | Re | | | | | | | | |
| Th | Ir | | | | | | | | |
| | Tl | | | | | | | | |

Among the 40 elements having more than two stable isotopes, there are a total of 222 stable isotopes. These totals include some isotopes which are slightly radioactive, but which have very long half lives and are present in naturally occurring samples of the elements. In most cases, the relative concentrations of the stable isotopes found in any given element anywhere on earth are constant to within one part in fifty thousand. The ratios are easily and precisely measured by various known techniques. Highly enriched samples of most stable isotopes are available commercially.

In this system, the abundance ratio of two or more isotopes in each of one or more elements in a substance is artificially controlled to provide for subsequent identification of the substance. For example, for labeling, or tagging, ten commercially prepared batches of ammunition, the element europium (Eu) can be used. It has two stable isotopes with atomic masses of 151 and 153. In natural europium, these two isotopes are present in the concentrations 47.77%, and 52.23% respectively. A code can be created for these batches by preparing a series of isotopic samples containing $^{151}$Eu and $^{153}$Eu in a patterned series of ten concentration ratios such as 5/95, 15/85, 25/75, 35/65, 45/55, 55/45, 65/35, 75/25, 85/15, and 95/5, with each ratio assigned to one specific batch. These samples can be prepared either with elemental europium, or with europium as an element in a compound such as $Eu_2O_3$. A small quantity of one of these samples can be added, by any of a number of means, to each batch of ammunition to be tagged, according to the following table.

TABLE II

| Batch | $^{151}$Eu/$^{153}$Eu (Abundance Ratio) |
|---|---|
| 0 | 5/95 |
| 1 | 15/85 |
| 2 | 25/75 |
| 3 | 35/65 |
| 4 | 45/55 |
| 5 | 55/45 |
| 6 | 65/35 |
| 7 | 75/25 |
| 8 | 85/15 |
| 9 | 95/5 |

Subsequent measurement of the concentration ratio of $^{151}$Eu to $^{153}$Eu in the ammunition, or in the residue left after it is fired, would yield a ratio identifying the batch in which the ammunition was manufactured. In this example, the ten unique values of the concentration ratio can distinguish each of the ten batches of ammunition.

A significant increase in the number of possible unique codes is achieved by using more than one pair of stable isotopes in creating the code. Continuing the above example, the code can be expanded by adding to the ammunition an additional element (e.g. neodymium, Nd) with its own specific concentration ratio of isotopes (e.g. $^{143}$Nd and $^{146}$Nd). The code can be further expanded by adding a third element with its specific isotope concentration ratio (e.g. dysprosium, $^{161}$Dy and $^{164}$Dy).

The following table illustrates how a system using these three pairs of isotopes can be used to create an identification code (e.g. a three digit serial number). The first column lists the serial number, the remaining columns list the abundance ratios of each of the europium isotopes $^{151}$Eu and $^{153}$Eu; the neodymium isotopes $^{143}$Nd and $^{146}$Nd; and the dysprosium isotopes $^{161}$Dy and $^{163}$Dy, respectively.

TABLE III

| | Isotope Abundance Ratios | | |
|---|---|---|---|
| Ser. No. | $^{151}$Eu/$^{153}$Eu | $^{143}$Nd/$^{146}$Nd | $^{161}$Dy/$^{163}$Dy |
| 000 | 5/95 | 5/95 | 5/95 |
| 001 | 5/95 | 5/95 | 15/85 |
| 002 | 5/95 | 5/95 | 25/75 |
| . . . | . . . | . . . | . . . |
| 009 | 5/95 | 5/95 | 95/9 |
| 010 | 5/95 | 15/85 | 5/95 |
| 011 | 5/95 | 15/85 | 15/85 |
| . . . | . . . | . . . | . . . |
| 099 | 5/95 | 95/5 | 95/5 |

TABLE III-continued

| | Isotope Abundance Ratios | | |
|---|---|---|---|
| Ser. No. | $^{151}$Eu/$^{153}$Eu | $^{143}$Nd/$^{146}$Nd | $^{161}$Dy/$^{163}$Dy |
| 100 | 15/85 | 5/95 | 5/95 |
| 101 | 15/85 | 5/95 | 15/85 |
| . . . | . . . | . . . | . . . |
| 998 | 95/5 | 95/5 | 85/15 |
| 999 | 95/5 | 95/5 | 95/5 |

By reference to this table, measurement of the three abundance ratios $^{151}$Eu/$^{153}$Eu, $^{143}$Nd/$^{146}$Nd, and $^{161}$Dy/$^{163}$Dy in a tagged substance will allow determination of the identification code (e.g. the serial number) of the substance. In this table, not all possible entries are shown. Using the coding scheme of Table III, a total of $10^3$ or 1000 unique serial numbers can be created. Additional pairs of isotopes could be used to provide additional digits, thereby increasing the number of available serial numbers. Following the same pattern, a system using N pairs of isotopes to create serial numbers results in $10^N$ unique serial numbers.

The example illustrated in Table III utilized 10% variations in the concentration ratios of each of the isotope pairs. In fact, smaller variations in the isotopic concentration ratios can be used and measured with sufficient accuracy to be useful in the present invention. When two pairs of isotopes are each controlled and measured to within 1% and combined in a single code, there are $100^2$ or ten thousand (10,000) unique codes available. Three pairs of isotopes at 1% precision would provide for $100^3$ or one million (1,000,000) unique codes. By extension, N pairs of isotopes, each controlled and measured to within 1% and combined in a single code, would produce $100^N$ unique codes. This system will allow simple and economic generation of a very large number of unique codes, such as would be useful for ammunition tagging.

Particulate Systems

The particulate category comprises those systems where the taggant information is encoded in small particles which are designed to survive the firing of the ammunition. An example in this category is the color coded plastic beads currently used for tagging explosives in Switzerland. Alternative identifying means also have been proposed for coding the particles, including particle shape, chemical composition, or even microscopic writing. Two principal issues arise when considering application of particulate taggants to ammunition. (1) If the particles are substantially destroyed in the firing of the ammunition, the taggant signal will be degraded or lost. For this reason, the particles are intentionally designed to be robust. This may lead to concerns about their potential effects on firearm mechanisms. (2) The particles are typically manufactured at a remote site, and in large batches, with every particle in a given batch having the same code. Under systems proposed to date, generating one million unique taggant codes would require fabricating one million batches of particles. In the current state of the art, no practical method is available for generating very large numbers of small batches of uniquely identical particles, and for integrating these into an ammunition manufacturing process.

A solution to the second problem is to use a fragmented coding system in which each particle encodes only a portion of a serial number. How this system would reduce the required number of distinct batches of particles is best illustrated by example. Suppose it is desired to have a given factory produce a run comprising a series of one million ammunition batches, each with its own serial number. If each taggant particle encodes an entire serial number, this would require one million unique batches of particles. Using a fragmented coding system, the same one million batches could be tagged with 301 batches of taggant particles as follows. The first batch of particles (called the master batch) would contain identifying information about the factory and the run, and could be encoded using any of a number of identifying means as described above. The remaining 300 batches of particles would consist of particles coded with a three element coding system, such as a three-band color code. These batches of particles would be divided equally into three groups; A, B, and C. The one hundred particle batches in group A would consist of particles where the first band is always one color, say blue. The remaining two bands would use a 10 color code to indicate the value of two digits of a digital serial number. The one hundred particle batches in groups B and C would similarly have a first band identifying the group, say yellow and red respectively. The remaining two bands would encode two digits of a digital serial number in the same manner as group A. Each batch of ammunition could then be uniquely identified by introducing particles from the master batch, and from one batch from each of groups A, B, and C. Assume that the 10-color encoding scheme follows the example of the electronics industry and used black, brown, red, orange, yellow, green, blue, violet, gray, and white to represent the digits 0 through 9 respectively. Then ammunition batch number 576,039, for example, would be tagged with the master particles, and with three additional particle batches. The first of these would have blue, green, and violet bands, with the green and violet representing 5 and 7 respectively, and the blue indicating that they encode the first two digits of the serial number. The second batch of particles would have yellow, blue, and black bands, and the third would have red, orange, and white bands. If a sample of residue from the ammunition in this batch is found, the taggant code could be read by finding a particle from each of the four particle batches. The numbers used here were picked for example purposes only. A similar method could be used employing six particle groups, each encoding only one digit of a digital serial number. This would require only 61 batches of particles for one million serial numbers. It is also possible to employ non-digital serial numbers. For example, an 8-color code could be used to encode base-8 serial numbers. Likewise, a 12-color code could be used to encode base-12 serial numbers. Identifying means other than color coding could also be used to encode the serial number components on the particles, or to identify which digits of the serial number are being encoded.

The key to reducing the total number of unique batches of particles, and thereby improve manufacturability, is the use of multiple batches of particles to encode a serial number piece by piece. An assembly line would then only need to control the injection of particles from selected batches to build up a large number of serial numbers from a relatively small number of distinct batches of particles. While very useful for ammunition, where identification of large numbers of separate batches would be useful for law enforcement purposes, the method proposed here has more general utility for any field of manufacture where there exists a need to separately identify a large number of discrete units of production. Examples include, but are not limited to, paint, crude oil, fuel oil, hazardous waste, paper, ink, drugs, raw materials used in the manufacture of drugs, chemicals, compact disks, laser disks, computer disks, video tapes, audio tapes, electronic circuits, explosives, currency, clothing, computers, electronic components, and automotive components.

Particulate tagging systems can also be combined advantageously with isotopic or chemical tagging systems. One disadvantage of the isotope ratio and chemical tagging systems is that it is not obvious whether or not a taggant is present in a given sample. Without resorting to a sophisticated chemical analysis, a tagged sample will appear identical to an untagged sample. A solution to this difficulty is to combine the isotopic taggant system with another system using particulates that are visible with the unaided eye, or with a simple magnifying glass or microscope. The primary purpose of the particulate taggant would be to indicate the presence of the isotopic or chemical taggant. The particulate taggant may also encode some information, such as the identity of the manufacturer, type of ammunition, date of manufacture, or place of manufacture, but because of its greater versatility, the isotopic or chemical taggant would carry most or all of the identifying information.

For any tagging system, there can be a concern about tags which have been counterfeited, altered, or contaminated by other tags. For example, if two rounds of ammunition were produced with powder tagged using the isotope ratio technique, then combining the powder from those two rounds would produce isotope ratios that would match neither of the initial tags. Subsequent reading of the isotope ratio in the powder would not identify either of the initial two batches, but could incorrectly identify a third unrelated batch as the source of the tag.

A way to avoid this problem is to use one or more additional pairs or multiples of isotopes to create an authentication code. Each taggant value would have a corresponding authentication code. If a taggant code is accidently created by combining two other codes, or through some other contamination process, it is unlikely that the correct authentication code would also be created. The degree of improbability is determined by the number of unique authentication codes. The following simplified example illustrates the technique. Assume that there are two batches of powder tagged using the isotope ratio system at 10% resolution. The first one is tagged with europium using the isotopes $^{151}$Eu and $^{153}$Eu in the ratio 25/75. This batch also contains an authentication code in the form of neodymium, with the isotopes $^{143}$Nd and $^{146}$Nd in the ratio 45/55. The second batch of powder is also tagged with europium, using the isotopes $^{151}$Eu and $^{153}$Eu in the ratio 45/55. This batch also contains an authentication code in the form of neodymium, with the isotopes $^{143}$Nd and $^{146}$Nd in the ratio 5/95. If these two batches were mixed in equal amounts, the taggant code of the europium in the combined batch would be read as 35/65, and the authentication code of the neodymium would be read as 25/75. As the taggants were using 10% variations in concentration ratios in forming the code, there is only one chance in 10 that this would be the correct authentication code. By using higher precisions, such as 1% resolution in forming the isotope ratio codes, and additional pairs or multiples of isotopes, the probability of accidently producing a correct authentication code can be made arbitrarily small. Similar authentication coding schemes can be used for particulate and chemical taggants. It may also be advantageous to create an authentication tag using a different system altogether than the identification tag. For example, a fragmented particulate identification taggant could be combined with an isotopic authentication taggant. Other combinations are also possible.

Methods of Application

Regardless of what type of taggant is used, the taggant must be applied to the ammunition so as to acceptably balance user concerns about possible effects on safety and performance, and the utility of the taggant. The most useful taggant will be one that can be read from the smallest sample of projectile, projectile fragment, or gunshot residue collected from a crime scene.

Gunshot residue typically consists of two types of particles. The first is recondensed projectile material which was vaporized by frictional heating of the projectile as it passed through the barrel of the firearm. The second type of particle is composed of the solid residue left behind by the reaction of the primer and propellant charges. Typically, the primer produces the majority of this material. Because most recovered projectiles and projectile fragments will be coated with detectable gunshot residue, a taggant which is uniformly dispersed in the gunshot residue will be of maximum utility. Ideally, it should be present at a concentration high enough to be read from a single residue particle.

An obvious way to maximize uniform distribution of the taggant in the residue would be to distribute it uniformly in the propellant charge (typically gunpowder). This method was used in most of the ammunition taggant tests conducted to date. Unfortunately, this method has the drawback that the taggant is in direct contact with the propellant, leading to concerns about sensitizing the propellant for premature ignition.

An alternative would be to blend the taggant with the primer reactants. The firing of the ammunition results in mixing of the primer reaction products with the propellant, thereby igniting the propellant. If the taggant is carried in the primer reaction products, it will be blended with the propellant as it is ignited, and will then be distributed throughout the gunshot residue. This method has the advantage that the taggant is not exposed to the propellant before the propellant is ignited. The concern about sensitizing the propellant is removed. However, in this method, the concern is transferred to the primer, which may be even more sensitive to the taggant than is the powder.

In an ideal case, the taggant would not be mixed with either the primer or propellant prior to firing the ammunition. This may be accomplished by placing the taggant between the primer and the propellant. When the ammunition is fired, the primer chemicals produce hot reaction products which normally mix with and ignite the propellant. If the taggant is in a layer between the primer and the propellant, it will be fragmented, and/or vaporized by the expansion of the hot primer product vapor. The taggant fragments and/or vapor will be entrained in the expanding gases from the primer, and will be mixed with the propellant as it is ignited. By this method, the taggant will be well dispersed in the gunshot residue.

To eliminate any remaining concern about possible sensitization of either the primer or the propellant by the taggant, the taggant can be isolated from both by having it sandwiched between two layers of materials known to be compatible with primer and propellant exposure, respectively. These layers would be of a predetermined thickness sufficient to ensure that the taggant remains isolated from both the primer and the propellant until the ammunition is fired. The isolating layers can be made of any material which is easily shredded, vaporized, burned, or otherwise destroyed by the expanding vapor plume of primer reaction products. Examples of possible barrier materials include paper, wax, and certain plastics. Other materials useful for this application are considered to be equivalents. FIG. 1 is a diagram of a primer showing how this system could be applied. The primer cup 10 contains the primer reactants 12, over which is deposited a protective layer 14, a taggant layer 16, and an additional protective layer 18.

The following is a specific embodiment of this system. In manufacturing a round of 0.38 caliber handgun ammunition, a primer is fabricated using a brass cup containing approximately 15 mg of primer chemicals. Over this is deposited a thin layer of wax, an additional layer containing approximately 15 ng of europium with the isotopes $^{151}$Eu and $^{153}$Eu in the ratio 25/75, and a final thin layer of wax. The primer is inserted into an empty brass case, to which is added approximately 200 mg of gunpowder propellant, and a projectile. When the round of ammunition has been fully assembled as described, neither the primer nor the propellant is exposed to the europium taggant.

When this round of ammunition is fired, the hot expanding vapors from the reaction of the primer chemicals will shred and vaporize the wax layers. The europium will be entrained in the primer vapor and will mix with the propellant as it is ignited. The europium will be oxidized, forming europium oxide, which will condense and mix with the gunshot residue. Since the europium was present initially at one part per million of the primer mass, any residue particle formed of primer material will contain at least 1 ppm of europium. Since the chemical reactions involved will not significantly alter the isotopic abundance ratio, the europium in the gunshot residue particles will have the same isotopic composition as the original taggant. A typical residue particle might have a mass of $3\times10^{-10}$ g, and will contain at least $3\times10^{-16}$ g of europium. This is about 1.2 million atoms. Measurement of the isotopic composition of the europium in this particle is possible using various mass spectrometric techniques. The number of atoms present is sufficient to ensure a statistically significant reading of the abundance ratio to better than 1% precision. Reading of this ratio will yield the original tagging isotopic composition, and therefore the serial number of the ammunition batch.

Figure 2:
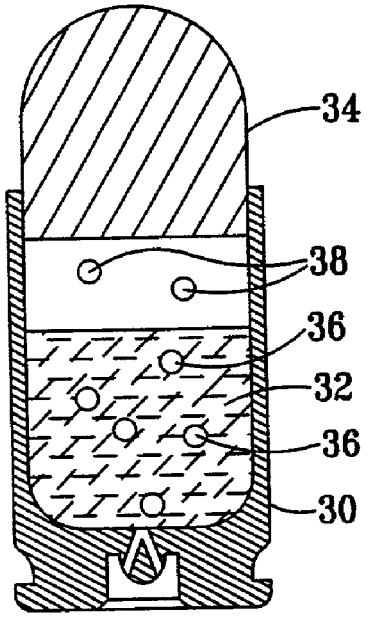
FIG. 2 is a partial cross-sectional view of a cartridge case and projectile adapted for use with preferred embodiments of the present invention.

An alternative to the wax encapsulated taggant would be to use a pellet insert. The pellet would be fabricated from a material, such as paper, which is easily destroyed by the chemical reaction of the primer or propellant. For example, a small disk of paper would be wetted with a volatile solvent containing a non-volatile taggant. The solvent would be allowed to evaporate, leaving the taggant in the paper. The dry paper disk would then be inserted into the primer cartridge. This is illustrated in FIG. 1, where taggant-containing pellets 20 are shown embedded within the primer reactants. Alternatively, the pellets 22 are attached to the surface of the primer reactants. When the ammunition is fired, the pellet would be destroyed and the taggant would be entrained by the primer vapors, mix with the igniting propellant, and ultimately condense in the gunshot residue. Such paper taggants could also simply be inserted in the cartridge case along with the propellant. This is illustrated in FIG. 2 where the cartridge case 30 contains propellant 32 and a projectile 34. The taggant pellets 36 are distributed throughout the propellant. Alternatively, the taggant pellets 38 can be added after the propellant, and remain between the propellant and the projectile. The paper would be destroyed in firing the ammunition and the taggants would be dispersed.

In the pellet system, the taggant would be dispersed throughout the pellet, which acts as a carrier. Alternatively, the taggant may be completely enclosed in a small capsule made of a material easily destroyed in firing the ammunition. This will further ensure that the taggant is completely isolated from the propellant or primer reactants. The taggant capsules could be deployed in the ammunition in the same manner as the pellets described above.

To reduce the risk of tampering, the taggant may be deposited such that it is covered by the primer reactants. The taggant may be deposited in the primer case prior to loading the primer reactants. This is illustrated in FIG. 1, where a taggant layer 24 is covered by a protective layer 26, and further covered by the primer reactants 12. If the taggant is easily vaporized, and is covered by a protective layer which is also easily vaporized, the firing of the ammunition would result in the taggant vapor being mixed with the primer vapor as it is expelled into, and ignites, the propellants. The taggant will thus be incorporated in the gunshot residue as it condenses.

If it is desired to tag the ammunition without tagging the primer, one could deposit the taggant on the inner wall of the cartridge case, and cover it with a layer of material to isolate it from the propellant. When the ammunition is fired, the covering layer and the taggant will be vaporized, entrained in the burning propellant, and ultimately deposited with the gunshot residue.

Were ammunition manufactured on an assembly line, with all the components moving sequentially through the various processing steps into the final packaging for shipment, it would be straight-forward to maintain a clear correspondence between position on the assembly line and the serial number of the ammunition round. This would be very useful for any system incorporating taggants in the primer, since primers are normally manufactured early in the process.

Current manufacturing processes, however, typically have the primers being fabricated in batches, which are then installed in cartridge cases in such a way that it would be difficult to keep track of the taggant serial number for any given round of ammunition.

A process which would eliminate this issue would be to print a small unique machine-readable label, such as a barcode, on each primer. A record is maintained of the correspondence between the barcode and the taggant code. As each round of ammunition is boxed for final shipment, the barcode of each primer is read, and a record is maintained of each taggant code in any given box of ammunition.

It is understood that the above-described preferred embodiments and examples are simply illustrative of the general principles of the present invention. Other formulations, arrangements, assemblies and materials may be used by those skilled in this art and which embody the principles of the present invention, which is limited only by the scope and spirit of the claims set forth below.

What is claimed is:

1. A method of encoding chemical taggants using multiple pairs of chemicals to represent the bits of a binary serial number wherein the presence of one chemical of each pair represents a first predetermined bit value and the presence of the other chemical of each pair represents a second predetermined bit value.

2. The method of claim 1 where one of the predetermined bit values is 0 and the other predetermined bit value is 1.

3. A method of encoding chemical taggants comprising:

identifying a group of M×N distinct chemical taggants where M and N are integers; and dividing said chemical taggants into M groups of N chemicals each; and assigning one taggant chemical from each of the M groups to correspond to each integer from 0 to N-1 inclusive; and isolating the substance to be tagged and assigning to it an M-digit, base-N serial number; and adding to the substance to be tagged a quantity of each of the M chemicals corresponding to the values of the M digits in the assigned serial number.

4. A binary taggant comprising:

at least a first chemical pair comprising:

a first chemical of the first chemical pair capable of functioning as a taggant and representative of the first of two binary values; and a second chemical of the first chemical pair capable of functioning as a taggant and representative of the second of the two binary values.

5. The binary taggant of claim 4 further comprising:

a second chemical pair comprising:

a first chemical of the second chemical pair capable of functioning as a taggant and representative of the first of two binary values; and a second chemical of the second chemical pair capable of functioning as a taggant and representative of the second of the two binary values.

6. The binary taggant of claim 4 further comprising:

at least two additional chemical pairs each of said pairs comprising:

a first chemical of each additional chemical pair capable of functioning as a taggant and representative of the first of two binary values; and a second chemical of each additional chemical pair capable of functioning as a taggant and representative of the second of the two binary values.

7. An encoded taggant system capable of representing any M-digit, base-N serial number where M and N are integers, comprising:

M×N distinct chemicals each capable of functioning as a taggant;

said M×N distinct chemicals grouped into M groups of N distinct chemicals in each of the M groups; and each of the N distinct chemical in each of the M groups corresponding to one integer from 0 to N-1 inclusive, whereby a quantity of the distinct chemicals corresponding to the values of a predetermined, M-digit, base-N serial number may be selected and added to a substance assigned to the predetermined serial number.

8. The taggant system of claim 7 wherein at least one of the taggant chemicals is isotopically substituted.

* * * * *